US005118440A

United States Patent [19]

Cutler et al.

[11] Patent Number: 5,118,440

[45] Date of Patent: Jun. 2, 1992

[54] LIGHT-DUTY LIQUID DISHWASHING DETERGENT COMPOSITION CONTAINING ALKYL POLYSACCHARIDE AND ALPHA-SULFONATED FATTY ACID ALKYL ESTER SURFACTANTS

[75] Inventors: Ann R. Cutler; Thomas A. Cripe, both of Cincinnati; James M. VanderMeer, Fairfield, all of Ohio

[73] Assignee: The Procter & Gamble Company, Cincinnati, Ohio

[21] Appl. No.: 488,597

[22] Filed: Mar. 5, 1990

[51] Int. Cl.[5] ..... C11D 1/12; C11D 1/83

[52] U.S. Cl. ..... 252/174.17; 252/545; 252/546; 252/547; 252/554; 252/555; 252/556

[58] Field of Search ..... 252/174.17, 554, DIG. 14, 252/555, 556, 545, 546, 547

[56] References Cited

U.S. PATENT DOCUMENTS

| | | | |
|---|---|---|---|
| 2,974,134 | 3/1961 | Pollitzer | 252/174.17 |
| 2,985,592 | 5/1961 | St. John | 252/137 |
| 3,219,656 | 11/1965 | Boettner | 252/174.17 |
| 3,314,936 | 4/1969 | Ames | 536/120 |
| 3,338,838 | 8/1967 | Wilson | 252/161 |
| 3,598,865 | 8/1971 | Lew | 252/89 |
| 3,640,998 | 2/1972 | Mansfield | 252/8.9 |
| 3,721,633 | 3/1973 | Ranauto | 252/527 |
| 3,772,269 | 11/1973 | Lew | 252/89 |
| 3,839,318 | 10/1974 | Mansfield | 536/18.6 |
| 4,011,389 | 3/1977 | Langdon | 536/4 |
| 4,223,129 | 9/1980 | Roth | 536/4 |
| 4,396,250 | 8/1983 | Payne et al. | 252/89.1 |
| 4,438,025 | 3/1984 | Satsuki et al. | 252/545 |
| 4,483,779 | 11/1984 | Llenado | 252/135 |
| 4,483,780 | 11/1984 | Llenado | 252/135 |
| 4,536,318 | 8/1985 | Cook et al. | 252/174.17 |
| 4,565,647 | 1/1986 | Llenado | 252/354 |
| 4,599,188 | 7/1986 | Llenado | 252/174.17 |
| 4,627,931 | 12/1986 | Malik | 252/153 |
| 4,663,069 | 5/1987 | Llenado | 252/117 |
| 4,668,422 | 5/1987 | Malik | 252/174.17 |
| 4,678,595 | 7/1987 | Malik | 252/174.17 |
| 4,732,696 | 3/1988 | Urfer | 252/174.17 |
| 4,732,704 | 3/1988 | Biermann | 252/548 |
| 4,834,903 | 5/1989 | Roth et al. | 252/174.17 |
| 4,839,098 | 6/1989 | Wistoski | 252/551 |
| 4,976,885 | 12/1990 | Wisotzki et al. | 252/174.17 |

FOREIGN PATENT DOCUMENTS

| | | |
|---|---|---|
| 0328361 | 8/1989 | European Pat. Off. . |
| 0341071 | 11/1989 | European Pat. Off. . |
| 1304198 | 12/1989 | Japan . |

OTHER PUBLICATIONS

Charles F. Putnik and Nelson F. Borys, Alkyl Polyglycosides, SOAP/COSMETICS/CHEMICALS SPECIALTIES (Jun., 1986).

"STA-MEG 106 Methyl Glucoside" Brochure from Horizon Chemical.

*Primary Examiner*—A. Lionel Clingman
*Assistant Examiner*—Kery Arthur Fries
*Attorney, Agent, or Firm*—Mary P. McMahon; Fernando A. Borrego; Kathleen M. Harleston

[57] ABSTRACT

A light-duty liquid dishwashing detergent composition containing (a) an alkyl polysaccharide surfactant, and (b) an alpha-sulfonated fatty acid alkyl ester surfactant, and optionally containing an auxiliary suds booster, wherein the weight ratio of (a)/(b) is from about 50/50 to about 95/5. The composition exhibits good grease removal and foaming while manifesting mildness to the skin.

20 Claims, No Drawings

LIGHT-DUTY LIQUID DISHWASHING DETERGENT COMPOSITION CONTAINING ALKYL POLYSACCHARIDE AND ALPHA-SULFONATED FATTY ACID ALKYL ESTER SURFACTANTS

TECHNICAL FIELD

This invention relates to light-duty liquid dishwashing detergent compositions, and specifically to said compositions containing alkyl polysaccharide and alpha-sulfonated fatty acid alkyl ester surfactant combinations. Said compositions provide good foaming and good detergency and are gentle to the skin.

BACKGROUND OF THE INVENTION

Alkyl polyglucoside surfactants have been disclosed in U.S. Pat. Nos. 3,598,865; 3,721,633; and 3,772,269. These patents also disclose processes for making alkyl polyglucoside surfactants and built liquid detergent compositions containing these surfactants. U.S. Pat. No. 3,219,656 discloses alkyl monoglucosides and suggests their utility as foam stabilizers for other surfactants. Various polyglucoside surfactant structures and processes for making them are disclosed in U.S. Pat. Nos. 2,974,134; 3,640,998; 3,839,318; 3,314,936; 3,346,558; 4,011,389; and 4,223,129.

Alkyl polyglucoside surfactants have also been disclosed in combination with several cosurfactants in cleaning compositions. U.S. Pat. No. 4,396,520 discloses a detergent composition containing an alkyl polysaccharide surfactant and a calcium sensitive anionic detergent cosurfactant. U.S. Pat. No. 4,565,647 discloses a foaming composition containing an alkyl polysaccharide surfactant and a sulfate, sulfonate, and/or carboxylate cosurfactant. U.S. Pat. No. 4,599,188 discloses a foaming composition containing an alkyl polysaccharide surfactant, a sulfate, sulfonate, and/or carboxylate cosurfactant, and an amide and/or amine oxide auxiliary foam booster. U.S. Pat. No. 4,732,704 discloses a manual dishwashing detergent composition containing an alkyl monoglucoside surfactant, an anionic surfactant of the sulfate or sulfonate type, and a fatty acid alkanol amide. U.S. Pat. No. 4,839,098 discloses a manual dishwashing detergent composition containing an alkyl polyglucoside surfactant and a dialkyl sulfosuccinate.

Detergent compositions containing alpha-sulfonated fatty acid alkyl esters are described in U.S. Pat. Nos. 3,338,838 and 4,438,025.

All percentages, parts, and ratios used herein are by weight unless otherwise specified.

SUMMARY OF THE INVENTION

This invention relates to the discovery of a particular combination of surfactants which provide good performance benefits, i.e., good foaming and detergency, in light-duty liquid dishwashing detergent compositions. Specifically, this invention relates to light-duty liquid dishwashing detergent compositions comprising, by weight:

(a) from about 10% to about 50%, preferably from about 15% to about 40%, most preferably from about 20% to about 30%, of an alkyl polysaccharide surfactant of the formula $$R\text{-}O\text{-}G_x$$

wherein R is on the average a $C_{10}$ to $C_{16}$, preferably $C_{12}$ to $C_{14}$, alkyl, G is a moiety derived from a reducing saccharide containing from 5 to 6 carbon atoms, preferably a glucose unit, and x is on the average from about 1.0 to about 3.0, preferably from about 1.1 to about 1.5;

(b) from about 2% to about 45%, preferably from about 4% to about 30%, most preferably from about 5% to about 15%, of an alpha-sulfonated fatty acid alkyl ester surfactant of the formula

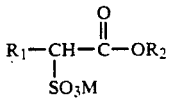

wherein $R_1$ is on the average a $C_8$ to $C_{16}$, preferably $C_{10}$ to $C_{14}$, alkyl, $R_2$ is on the average a $C_1$ to $C_6$, preferably $C_1$ to $C_2$, alkyl, and M is a cation, preferably ammonium, sodium, potassium, magnesium, or mixtures thereof; and (c) from 0% to about 10%, preferably from about 1% to about 7%, of an auxiliary suds booster, preferably selected from the group consisting of alkyl dimethyl amine oxides, alkyl amido propyl betaines, alkyl dimethyl betaines, alkyl dimethyl sulfo betaines, alkyl amides, and mixtures thereof; wherein the weight ratio of (a)/(b) is from about 50/50 to about 95/5, preferably from about 60/40 to about 90/10, most preferably from about 70/30 to about 80/20.

A preferred embodiment of this invention pertains to the above-stated composition wherein the amount of alpha-sulfonated carboxylic acid by-product of the standard process for making the alpha-sulfonated fatty acid alkyl ester surfactant in the composition is less than about 20%, preferably less than about 10%, by weight of the alpha-sulfonated fatty acid alkyl ester surfactant. This is most critical in formulas wherein (a)/(b) approaches 50/50.

It has surprisingly been found that the present combination of alkyl polysaccharide and alpha-sulfonated fatty acid alkyl ester surfactants at specified ratios provides unexpected performance benefits, in particular, good sudsing. This is particularly unexpected since alpha-sulfonated fatty acid alkyl ester surfactants alone perform less effectively than other anionic surfactants like the sulfate, sulfonate, and carboxylate surfactants disclosed in U.S. Pat. Nos. 4,565,647; 4,599,188; and 4,732,704.

DETAILED DESCRIPTION OF THE INVENTION

The Alkyl Polysaccharide Surfactant

The compositions of this invention contain from about 10% to about 50%, preferably from about 15% to about 40%, most preferably from about 20% to about 30%, of an alkyl polysaccharide surfactant of the formula $$R\text{-}O\text{-}G_x$$

wherein R is on the average a $C_{10}$ to $C_{16}$, preferably a $C_{12}$ to $C_{14}$, alkyl; G is a moiety derived from a reducing saccharide containing from 5 to 6 carbon atoms, preferably a glucose unit; and x is on the average from about 1.0 to about 3.0, preferably from about 1.1 to about 1.5, and represents the average degree of polymerization (D.P.) of the alkyl polysaccharide surfactant. For a particular alkyl polysaccharide molecule, x can only assume integral values. In any physical sample of alkyl polyglucoside surfactants, there will generally be molecules having different values of x. The physical sample can be characterized by the average value of x, which can assume non-integral values. In the specification, the values of x are to be understood to be average values.

The polysaccharide hydrophilic portion of the surfactant contains from about 1 to about 3, preferably from 1.1 to about 1.5, saccharide units on the average. The saccharide unit may be galactoside, glucoside, lactoside, fructoside, glucosyl, fructosyl, lactosyl, and/or galactosyl units. Mixtures of these saccharide moieties may be used in the alkyl polysaccharide surfactant. Glucoside is the preferred saccharide moiety. Other saccharide moieties will act similarly, but because glucoside is the preferred saccharide moiety, the remaining disclosure will focus on the alkyl polyglucoside surfactant.

The hydrophobic group on the alkyl polysaccharide is an alkyl group, either saturated or unsaturated, branched or unbranched, containing from about 10 to about 16 carbon atoms on the average. Preferably, the alkyl group is primarily a straight chain saturated $C_{12}$ to $C_{14}$ alkyl group.

To prepare the preferred alkyl polyglucoside compounds, a long chain alcohol (e.g., containing from about 10 to about 16 carbon atoms) can be reacted with glucose in the presence of an acid catalyst to form the desired glucoside. Alternatively, the alkyl polyglucosides can be prepared by a two-step procedure in which a short chain alcohol (e.g., containing from about 1 to about 6 carbon atoms) is reacted with glucose or a polyglucoside ($x=2$ to 4) to yield a short chain alkyl glucoside ($x=1$ to 4) which can in turn be reacted with a long chain alcohol to displace the short chain alcohol and obtain the desired alkyl polyglucoside. If this two-step procedure is used, the short chain alkyl glucoside content of the final alkyl polyglucoside material should be less than 50%, preferably less than 10%, and more preferably less than 5%. Most preferably, the final material is substantially free of the short chain alkyl polyglucoside.

The amount of unreacted alcohol (the free fatty alcohol content) in the desired alkyl polyglucoside surfactant is preferably less than about 2%, more preferably less than about 0.5%, by weight of the total of the alkyl polyglucoside plus unreacted alcohol. This is preferably accomplished by removing the fatty alcohols from the polysaccharide products in thin film evaporators as described in U.S. Pat. No. 4,393,203, Mao et al, issued Jul. 12, 1983, incorporated herein by reference. The amount of alkyl monoglucoside is about 30% to about 80%, preferably 35% to 75%, most preferably 40% to 65%, by weight of the total of the alkyl polyglucoside surfactant.

Due to the possible presence of some unreacted alcohol in the alkyl polyglucoside surfactant, the average degree of polymerization (i.e., average x) of the mixture of the desired alkyl polyglucoside and alcohol may fall below the claimed value of 1.0, e.g., may be as low as about $x=0.8$.

Alkyl polysaccharides can be analyzed effectively via chromatographic techniques such as super-critical fluid chromatography. Using this analytical tool on alkyl polysaccharides derivitized with BSTFA (N,O-bis(-trimethylsilyl)trifluoroacetamide) allows one to quantitate both the average alkyl chain length and degree of polymerization (D.P.) as well as the distribution of alkyl and sugar units. The above method is most effective when using response factors calculated from pure alkyl polysaccharide standards which can be synthesized or purchasaed, e.g., from Calbiochem.

The Alpha-Sulfonated Fatty Acid Alkyl Ester

The compositions of this invention also contain from about 2% to about 45%, preferably from about 4% to about 30%, most preferably from about 5% to about 15%, of an alpha-sulfonated fatty acid alkyl ester of the formula:

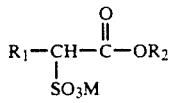

wherein $R_1$ is on the average a $C_8$ to $C_{16}$, preferably a $C_{10}$ to $C_{14}$, alkyl; $R_2$ is on the average a $C_1$ to $C_6$, preferably a $C_1$ to $C_2$ alkyl; and M is a cation, preferably ammonium, sodium, potassium, magnesium, or mixtures thereof.

The hydrophobic portion of this surfactant has the sulfonate group at the alpha position, i.e., the sulfonate group is positioned at the first carbon atom, and contains from about 10 to about 18 carbon atoms on the average. Preferably, the alkyl portion of this hydrophobic portion is a straight chain, saturated $C_{12}$ to $C_{16}$ hydrocarbon.

This cosurfactant is neutralized with a cationic moiety or moieties, M, to complete the formula. Preferably, M is selected from the group consisting of ammonium, sodium, potassium, magnesium, or mixtures thereof. Most preferably, M is a mixture containing magnesium.

The amount of alpha-sulfonated carboxylic acid byproduct (di-salt) of the standard process for making the alpha-sulfonated fatty acid alkyl ester surfactant is preferably less than about 20%, most preferably less than about 10%, by weight of the total of the fatty acid alkyl ester plus carboxylic acid. The reduction in the alpha-sulfonated carboxylic acid content improves the performance and formulatability of the compositions.

Alpha-sulfonated fatty acid alkyl ester surfactants useful in compositions of the invention can be prepared by the following procedure: alkyl esters of long chain fatty acids are sulfonated with $SO_3$ in a molar ratio of alkyl ester:$SO_3$ of from about 1:1.1 to about 1:1.4 using a falling film reactor. The reactor temperature is between about 120° F. (49° C.) and 195° F. (91° C.). A digestion period follows this sulfonation whereby the mixture is allowed to react in a tank for about 20 to 60 minutes at about 140°-176° F. (60°-80° C.).

To reduce the formation of di-salts, the digested acid mix is transesterified with at least about 1 molar equivalent, with respect to the excess $SO_3$ employed, of an alcohol (preferably ethanol) for 15-30 minutes at about 140°-176° F. (60°-80° C.). The material is then bleached with hydrogen peroxide at about 140°-176° F. (60°-80° C.) to achieve a light color. Finally, the material is neutralized to a pH of about 7 at a temperature as low as possible, i.e., 86°-104° F. (30°-40° C.).

Stepan's Alpha Step ML-40® is a suitable fatty acid alkyl ester for use in compositions of the invention. However, Alpha Step ML-40® has an odor and color that may be unacceptable for use in dishwashing detergent compositions. Therefore, a highly unsaturated fatty acid alkyl ester should be used as a feedstock in the process described above. For example, Procter & Gamble's CE 1270® fatty acid methyl ester may be used as feedstock for the process.

The ratio of alkyl polyglucoside surfactant, (a), to alpha-sulfonated fatty acid alkyl ester surfactant, (b), is crucial to the claimed invention herein. Unlike other anionic surfactants, alpha-sulfonated fatty acid alkyl ester surfactants (SES) alone exhibit poor sudsing characteristics in light-duty liquid dishwashing detergent compositions. Other sulfate or sulfonate type surfactants alone provide a much higher level of foaming relative to SES. Alkyl polyglucoside surfactants (APG) alone exhibit poor sudsing characteristics in light-duty liquid dishwashing detergent compositions also. An APG/anionic (other than SES) surfactant system would be expected to furnish foaming and grease cutting properties which would be acceptable in these detergent compositions since the anionic surfactant's sudsing benefits would compensate for the APG's poor sudsing. An APG/SES surfactant system, on the other hand, would be expected to minimally enhance performance attributes of detergent compositions based on the individual characteristics of the surfactants. A surfactant system comprised of two surfactants which individually exhibit poor foaming, i.e., APG and SES, could not be expected to provide a detergent composition with the performance benefits required for manual dishwashing.

Surprisingly, though, APG/SES surfactant mixtures at ratios of APG/SES of from about 50/50 to 95/5, preferably from about 60/40 to 90/10, most preferably from about 70/30 to 80/20, provide performance attributes well above those acceptable for dishwashing detergent compositions. Used in combination with the preferred suds booster described below, APG/SES surfactant mixtures provide superior suds mileage and grease/oil removal. Furthermore, both required components of the detergent composition may be derived from renewable (non-petroleum) stocks which are readily biodegradable.

The Auxiliary Suds Booster

Another component which may be included in the composition of this invention is an auxiliary suds booster at a level of from 0% to about 10%, preferably from about 1% to about 7%. Optional suds stabilizing surfactants operable in the instant compositions are of three basic types—betaines, amine oxide semi-polar nonionics, and fatty acid amides.

The compositions of this invention can contain betaine detergent surfactants having the general formula:

$$R-\overset{(+)}{N}(R^1)_2-R^2\overset{(-)}{COO}$$

wherein R is a hydrophobic group selected from the group consisting of alkyl groups containing from about 10 to about 22 carbon atoms, preferably from about 12 to about 18 carbon atoms, alkyl aryl and aryl alkyl groups containing a similar number of carbon atoms with a benzene ring being treated as equivalent to about 2 carbon atoms, and similar structures interrupted by amido or ether linkages; each $R^1$ is an alkyl group containing from 1 to about 3 carbon atoms; and $R^2$ is an alkylene group containing from 1 to about 6 carbon atoms.

Examples of preferred betaines are dodecyl dimethyl betaine, cetyl dimethyl betaine, dodecyl amidopropyldimethyl betaine, tetradecyldimethyl betaine, tetradecylamidopropyldimethyl betaine, and dodecyldimethylammonium hexanoate.

Other suitable amidoalkylbetaines are disclosed in U.S. Pat. Nos. 3,950,417; 4,137,191; and 4,375,421; and British Patent GB No. 2,103,236, all of which are incorporated herein by reference.

It will be recognized that the alkyl (and acyl) groups for the above betaine surfactants can be derived from either natural or synthetic sources, e.g., they can be derived from naturally occurring fatty acids; olefins such as those prepared by Ziegler, or Oxo processes; or from olefins separated from petroleum either with or without "cracking".

Amine oxide semi-polar nonionic surfactants comprise compounds and mixtures of compounds having the formula

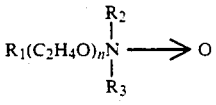

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_2$ and $R_3$ are each methyl, ethyl, propyl, isopropyl, 2-hydroxyethyl, 2-hydroxypropyl, or 3-hydroxypropyl, and n is from 0 to about 10. Particularly preferred are amine oxides of the formula:

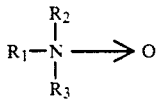

wherein $R_1$ is a $C_{12-16}$ alkyl and $R_2$ and $R_3$ are methyl or ethyl.

Examples of the amide surfactants useful herein include the ammonia, monoethanol, and diethanol amides of fatty acids having an acyl moiety containing from about 8 to about 18 carbon atoms and represented by the general formula:

$$R_1\text{-}CO\text{-}N(H)_{m-1}(R_2OH)_{3-m}$$

wherein R is a saturated or unsaturated, aliphatic hydrocarbon radical having from about 7 to 21, preferably from about 11 to 17 carbon atoms; $R_2$ represents a methylene or ethylene group; and m is 1, 2, or 3, preferably 1. Specific examples of said amides are mono-ethanol coconut fatty acid amide and diethanol dodecyl fatty acid amide. These acyl moieties may be derived from naturally occurring glycerides, e.g., coconut oil, palm oil, soybean oil, and tallow, but can be derived synthetically, e.g., by the oxidation of petroleum or by hydrogenation of carbon monoxide by the Fischer-Tropsch process. The monoethanol amides and diethanolamides of $C_{12}$ to $C_{14}$ fatty acids are preferred.

The above amides and amine oxides are more fully described in U.S. Pat. No. 4,316,824 (Pancheri), incorporated herein by reference. The above betaines are more fully described in U.S. Pat. No. 4,555,360, incorporated herein by reference.

The suds boosters used in the composition of this invention can contain any one or mixture of the suds boosters listed above.

The preferred sudsing characteristics of the compositions of the invention are those which will provide the user of the product with an indication of cleaning potential in a dishwashing solution. Soils encountered in dishwashing behave like suds depressants, and the presence or absence of suds from the surface of a dishwashing solution is a convenient guide to product usage. Mixtures of anionic surfactants and suds stabilizing nonionic surfactants, especially betaines and amine oxide nonionic surfactants, are preferably utilized in the compositions of the invention because of their high sudsing characteristics, their suds stability in the presence of food soils, and their ability to indicate accurately an adequate level of product usage in the presence of soil.

Most preferred of the suds boosters are alkyl dimethyl amine oxides, alkyl amido propyl betaines, alkyl dimethyl betaines, alkyl dimethyl sulfo betaines, and mixtures thereof. Fatty alkyl amides are less preferred because of the poorer sudsing characteristics they provide in compositions of the invention. Yet mixtures of amides and the above amine oxides and betaines do provide sufficient sudsing benefits for the compositions.

Additional Optional Ingredients

In addition to the ingredients described hereinbefore, the compositions can contain other conventional ingredients suitable for use in liquid dishwashing compositions.

Optional ingredients include drainage promoting ethoxylated nonionic surfactants of the type disclosed in U.S. Pat. No. 4,316,824, Pancheri (Feb. 23, 1982), incorporated herein by reference.

Others include detergency builders, either of the organic or inorganic type. Examples of water-soluble inorganic builders which can be used, alone or in admixture with themselves or with organic alkaline sequestrant builder salts, are alkali metal carbonates, phosphates, polyphosphates, and silicates. Specific examples of such salts are sodium tripolyphosphate, sodium carbonate, potassium carbonate, sodium pyrophosphate, potassium pyrophosphate, potassium tripolyphosphate, and sodium hexametaphosphate. Examples of organic builder salts which can be used alone, or in admixture with each other or with the preceding inorganic alkaline builder salts, are alkali metal polycarboxylates, e.g., water-soluble citrates such as sodium and potassium citrate, sodium and potassium tartrate, sodium and potassium ethylenediaminetetraacetate, sodium and potassium N-(2-hydroxyethyl)-ethylene diamine triacetates, sodium and potassium nitrilo triacetates (NTA), sodium and potassium N-(2-hydroxyethyl)-nitrilo diacetates, sodium and potassium oxydisuccinates, and sodium and potassium tartrate mono- and di-succinates, such as described in U.S. Pat. No. 4,663,071 (Bush et al., issued May 5, 1987), incorporated herein by reference. Other organic detergency builders such as water-soluble phosphonates can find use in the compositions of the invention. In general, however, detergency builders have limited value in dishwashing detergent compositions, and use at levels above about 10% can restrict formulation flexibility in the liquid compositions herein because of solubility and phase stability considerations.

Alcohols, such as ethyl alcohol and propylene glycol, and hydrotropes, such as sodium and potassium toluene sulfonate, sodium and potassium xylene sulfonate, trisodium sulfosuccinate, and related compounds (as disclosed in U.S. Pat. No. 3,915,903, incorporated herein by reference), and urea, can be utilized in the interests of achieving a desired product phase stability and viscosity. Alcohols such as ethyl alcohol and propylene glycol at a level of from 0% to about 15%, potassium or sodium toluene, xylene, or cumene sulfonate at a level of from 0% to about 10% and urea at a level of from 0% to about 10% are particularly useful in the compositions of the invention.

Other desirable ingredients include diluents and solvents. Diluents can be inorganic salts, such as sodium sulfate, ammonium chloride, sodium chloride, sodium bicarbonate, etc., and the solvents include water, lower molecular weight alcohols, such as ethyl alcohol, isopropyl alcohol, etc. Compositions herein will typically contain up to about 80%, preferably from about 30% to about 70%, most preferably from about 40% to about 65%, of water.

The following Examples illustrate the invention and facilitate its understanding.

EXAMPLE I

The following four compositions of the present invention are prepared according to the description set forth below.

Formulations A, B, and C are made by adding ethanol and sodium chloride to the sodium alpha-sulfonated $C_{12-14}$ alkyl methyl ester. The alkyl polyglucoside is mixed in, and the temperature of the mixture is raised to about 104° F. (40° C). The betaine or amine oxide is then added and mixed in. Finally, the magnesium chloride is added and mixed in, followed by viscosity and pH adjustment. Lastly the perfume and dye are added, with the balance being water.

Formulation D is made in a similar manner except the fatty acid monoethanolamine amide is warmed to about 149° F. (65° C.) before it is added to the alpha-sulfonated alkyl methyl ester/alkyl polyglucoside mixture.

| | % By Weight | | | |
|---|---|---|---|---|
| Components | Formulation A | Formulation B | Formulation C | Formulation D |
| Sodium α-sulfonated $C_{12-14}$ alkyl methyl ester | 7 | 7 | 14 | 14 |
| $C_{12-13}$ alkyl polyglucoside (1.4 ave.) | 21 | 21 | 14 | 14 |
| $C_{12-14}$ alkyl dimethyl betaine | 4.0 | — | — | — |
| $C_{12-14-16}$ alkyl dimethyl amine oxide | — | 4.0 | — | — |
| $C_{12-14}$ amidopropyl betaine | — | — | 4.0 | — |
| $C_{12-14}$ fatty acid monoethanolamine amide | — | — | — | 4.0 |
| Magnesium ion (added as $MgCl_2.6H_2O$) | 0.76 | 0.76 | 0.6 | — |
| Sodium xylene sulfonate | 3.0 | 3.0 | 3.0 | 3.0 |
| Ethanol | 7.5 | 7.5 | 7.5 | 7.5 |
| Perfume and dye | 0.15 | 0.15 | 0.15 | 0.15 |
| Water | Balance | Balance | Balance | Balance |

-continued

| Components | % By Weight Formulation A | Formulation B | Formulation C | Formulation D |
|---|---|---|---|---|
| Product pH | 7-7.5 | 7-7.5 | 7-7.5 | 7-7.5 |

Formulations A-D provide good sudsing characteristics and stable foams.

EXAMPLE II

The following formulations can be made by a similar method as Example I.

| Components | % By Wt. N1 | N2 | N3 |
|---|---|---|---|
| $C_{12-13}$ alkyl polyglucoside (1.4 ave.) | 21.0 | 20.5 | 27 |
| Sodium α-sulfonated $C_{12-14}$ alkyl methyl ester | 7.0 | 6.5 | — |
| $C_{12-14}$ alkyl dimethyl betaine | — | 1.5 | 1.5 |
| $C_{12-14-16}$ alkyl dimethyl amine oxide | 3.0 | — | — |
| $C_{10}$ alkyl ethoxy (8.0 ave.) alcohol | — | 4.0 | 4.0 |
| $C_{12-14}$ fatty acid monoethanol amine amide | — | 3.8 | 3.8 |
| Water, minor ingredients | Balance | Balance | Balance |

Formulations N1 and N2 provide good suds volume and suds mileage. Formulation N3, an all-APG formula, provides similar suds volume but does not provide adequate suds mileage. In other words, Formulations N1 and N2 provide sudsing characteristics which last longer as they are stressed with soil samples than those provided by Formulation N3.

EXAMPLE III

The following formulations are made in dilute solution. The corresponding wt. % of each component in a light-duty liquid dishwashing detergent composition of this invention appears in brackets, assuming a typical dilution of a light-duty liquid dishwashing detergent composition of 0.067%.

| | ppm In Solution Formulation: 1 | 2 | 3 | 4 | 5 |
|---|---|---|---|---|---|
| $C_{12-13}$ alkyl polyglucoside (1.4 ave.) | 185 (28) | 139 (21) | 92 (14) | 46 (7) | — |
| Sodium α-sulfonated $C_{12-14}$ alkyl methyl ester | — | 46 (7) | 92 (14) | 139 (21) | 185 (28) |

Formulations 2 and 3 provide superior sudsing characteristics to Formulations 1, 4, and 5.

EXAMPLE IV

Formulations 1-5 from Example III can be supplemented with auxilary suds boosters. To the dilute solutions of each formulation, 20 ppm (3 wt. % in a dishwashing detergent composition) of the following suds boosters is added:

(a) $C_{12-14-16}$ alkyl dimethyl amine oxide;
(b) $C_{12-14}$ alkyl acyl amido propyl betaine.
(c) $C_{12-14}$ fatty acid monoethanol amine amide.

The formulations containing the amine oxide or betaine suds booster provided superior foaming and sudsing benefits to the formulations containing the amide suds booster. Formulations 1-5 with the auxiliary suds booster provided a range of foaming and sudsing charcteristics with the rank order being Formulation 2>Formulation 3>Formulation 4>>Formulations 1 and 5.

EXAMPLE V

Compositions containing alpha-sulfonated carboxylic acid by-product of the standard process for making the alpha-sulfonated fatty acid alkyl ester surfactant are shown below:

| Components | Wt. % Y | Z |
|---|---|---|
| $C_{12-13}$ alkyl polyglucoside (1.4 ave.) | 14 | 14 |
| Sodium α-sulfonated $C_{12-14}$ alkyl methyl ester | 13 | 10 |
| Sodium α-sulfonated $C_{12-14}$ carboxylic acid | 1* | 4** |
| Water, minor ingredients | Balance | Balance |

*Represents approximately 7.7% of the sodium α-sulfonated alkyl methyl ester.
**Represents approximately 25% of sodium α-sulfonated alkyl methyl ester.

Formulation Y provides superior sudsing and foaming characteristics to Formulation Z, particularly in water containing high levels of calcium and/or magnesium ions (i.e., hard water), e.g., >14 gpg $Mg^{++}$ and/or $Ca^{++}$.

What is claimed is:

1. A light-duty liquid dishwashing detergent composition comprising, by weight:

(a) from about 10% to about 50% of an alkyl polysaccharide surfactant of the formula $$R\text{-}O\text{-}G_x$$

wherein R is on the average a $C_{10}$ to $C_{16}$ alkyl, G is a moiety derived from a reducing saccharide containing from 5 to 6 carton atoms, and x is on the average from about 1.0 to about 3.0;

(b) from about 2% to about 45% of an alpha-sulfonated fatty acid alkyl ester surfactant of the formula

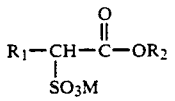

wherein $R_1$ is on the average a $C_8$ to $C_{16}$ alkyl, $R_2$ is on the average a $C_1$ to $C_6$ alkyl, and M is a cation; and (c) from 0% to about 10% of an auxiliary suds booster; wherein the weight ratio of (a)/(b) is from about 50/50 to about 95/5.

2. The composition of claim 1 wherein R is on the average a $C_{12}$ to $C_{14}$ alkyl, G is a glucose unit, and x is on the average from about 1.1 to about 1.5.

3. The composition of claim 1 comprising from about 15% to about 40% of the alkyl polysaccharide surfactant.

4. The composition of claim 2 comprising from about 20% to about 30% of the alkyl polysacchride surfactant.

5. The composition of claim 1 wherein $R_1$ is on the average a $C_{10}$ to $C_{14}$ alkyl, $R_2$ is on the average a $C_1$ to $C_2$ alkyl, and M is selected from the group consisting of ammonium, sodium, potassium, magnesium, and mixtures thereof.

6. The composition of claim 1 comprising from about 4% to about 30% of the alpha-sulfonated fatty acid alkyl ester surfactant.

7. The composition of claim 5 comprising from about 5% to about 15% of the alpha-sulfonated fatty acid alkyl ester surfactant.

8. The composition of claim 7 wherein the alpha-sulfonated fatty acid alkyl ester comprises less than about 20% of an alpha-sulfonated carboxylic acid.

9. The composition of claim 1 wherein R is on the average a $C_{12}$ to $C_{14}$ alkyl, G is a glucose unit, x is on the average from about 1.1 to about 1.5, $R_1$ is on the average a $C_{10}$ to $C_{14}$ alkyl, $R_2$ is on the average a $C_1$ to $C_2$ alkyl, and M is selected from the group consisting of ammonium, sodium, potassium, magnesium, and mixtures thereof.

10. The composition of claim 1 comprising from about 20% to about 30% of the alkyl polysaccharide surfactant and from about 5% to about 15% of the alpha-sulfonated fatty acid alkyl ester surfactant.

11. The composition of claim 9 comprising from about 20% to about 30% of the alkyl polysaccharide surfactant and from about 5% to about 15% of the alpha-sulfonated fatty acid alkyl ester surfactant.

12. The composition of claim 1 wherein the ratio of (a)/(b) is from about 60/40 to about 90/10.

13. The composition of claim 10 wherein the ratio of (a)/(b) is from about 70/30 to about 80/20.

14. The composition of claim 12 wherein the ratio of (a)/(b) is from about 70/30 to about 80/20.

15. The composition of claim 1 comprising from about 1% to about 7% of suds booster.

16. The composition of claim 11 comprising from about 1% to about 7% of suds booster.

17. The composition of claim 13 comprising from about 1% to about 7% of suds booster.

18. The composition of claim 15 wherein the auxiliary suds booster is selected from the group consisting of alkyl dimethyl amine oxides, alkyl amido propyl betaines, alkyl dimethyl betaines, alkyl dimethyl sulfo betaines, alkyl amides, and mixtures thereof.

19. The composition of claim 16 wherein the auxiliary suds booster is selected from the group consisting of alkyl dimethyl amine oxides, alkyl amido propyl betaines, alkyl dimethyl betaines, alkyl dimethyl sulfo betaines, alkyl amides, and mixtures thereof.

20. The composition of claim 17 wherein the auxiliary suds booster is selected from the group consisting of alkyl dimethyl amine oxide, alkyl amido propyl betaine, alkyl dimethyl betaine, and mixtures thereof.

* * * * *

UNITED STATES PATENT AND TRADEMARK OFFICE

CERTIFICATE OF CORRECTION

PATENT NO. : 5,118,440

DATED : June 2, 1992

INVENTOR(S) : Ann R. Cutler, Thomas A. Cripe, James M. VanderMeer

It is certified that error appears in the above-identified patent and that said Letters Patent is hereby corrected as shown below:

Column 12, line 8, "suds booster" should be --an auxiliary suds booster--.

Column 12, line 10, "suds booster" should be --an auxiliary suds booster--.

Column 12, line 12, "suds booster" should be --an auxiliary suds booster--.

Signed and Sealed this

Thirteenth Day of July, 1993

*Attest:*

*Attesting Officer*

Michael K. Kirk

MICHAEL K. KIRK

*Acting Commissioner of Patents and Trademarks*